United States Patent [19]

Shima

[11] 4,242,979

[45] Jan. 6, 1981

[54] SCREW PROPELLER WITH NO SHAFT BOSS AND SHIP THRUSTER USING SUCH SCREW PROPELLER

[76] Inventor: Kiyoshi Shima, 1-10-17 Tsujido-Shinmachi, Fujisawa-shi, Kanagawa-ken, Japan

[21] Appl. No.: 955,324

[22] Filed: Oct. 27, 1978

[30] Foreign Application Priority Data

Nov. 9, 1977 [JP] Japan ..... 52-134332
Nov. 30, 1977 [JP] Japan ..... 52-160643[U]

[51] Int. Cl.[3] ..... B63H 1/14; B63H 5/06

[52] U.S. Cl. ..... 440/38; 415/122 A; 440/75

[58] Field of Search ..... 115/34 B; 415/122 A; 416/157 A; 114/151

[56] References Cited

U.S. PATENT DOCUMENTS

| | | | |
|---|---|---|---|
| 2,605,606 | 8/1952 | Pilz | 415/122 |
| 3,487,805 | 1/1970 | Satterthwaite | 115/34 B |
| 3,655,294 | 4/1972 | Thatcher | 415/122 A |
| 3,759,211 | 9/1973 | Kuntz, Jr. | 115/34 B |

*Primary Examiner*—Douglas C. Butler
*Attorney, Agent, or Firm*—Lackenbach, Lilling & Siegel

[57] ABSTRACT

A propeller with no shaft boss comprising a substantially cylindrical rotatable member and several propeller blades extending radially of the cylindrical member close to the center axis thereof, and a ship thruster system adapted with the propeller having its cylindrical member disposed in a suction and exhaust port formed in the hull, and the cylindrical member is arranged to receive the rotative force from a motor so as to be rotated.

4 Claims, 6 Drawing Figures

SCREW PROPELLER WITH NO SHAFT BOSS AND SHIP THRUSTER USING SUCH SCREW PROPELLER

BACKGROUND OF THE INVENTION

This invention relates to a screw propeller with no shaft boss (hereinafter referred to as bossless screw propeller) designed to be mounted in the hull for effecting back and forth or rightward and leftward movements of the ship, and a ship thruster adapted with said bossless screw propeller and disposed at the bow and/or ship bottom to allow easy and quick movement of the ship for its coming alongside or leaving a pier.

A screw propeller mounted in the ship bottom close to the stern has been used for effecting the forward or backward movement of the ship, while the ship movement for bringing the ship alongside the pier or moving it away from the pier has been accomplished by ejecting water to the right or left side of the ship by the propellers of the thruster units mounted centrally in the holes formed at the bow and stern so that such holes are in communication sidewise with each other at the ship bottom.

However, since the conventional screw propellers are of the shaft propeller system and the same system is used for the thruster units as well, the water ejected out by the propellers produces a hollow screw thrust due to the presence of the shaft boss, thus resulting in a limited thrust output. Another serious problem of the conventional shaft propeller type thruster devices is that the shaft torque is necessarily increased, necessitating the use of a high-power engine.

OBJECTS OF THE INVENTION

The primary object of this invention is to provide a screw propeller capable of producing a bar water pressure thrust and improved in ship steering efficiency.

Another object of this invention is to provide a thruster device with high steering performance by using a propeller with no shaft boss for producing bar water pressure from starboard or port side ejection of water.

BRIEF SUMMARY OF THE INVENTION

In order to implement the above-said objects of this invention, a bossless screw propeller comprising propeller blades extending radially inwardly from the inner circumferential periphery of a cylindrical member is provided in each suction and exhaust port or other locations and said cylindrical member is rotated by the driving force of a motor. When said cylindrical member is rotated, the propeller blades secured thereto are turned accordingly so that water sucked up from one opening of the suction and exhaust port is ejected out from the other opening thereof. The ejected water produces strong bar water pressure to effect movement of the ship.

These and other objects and features of the invention will be more definitely understood from reading the following detailed description of the invention in conjunction with the accompanying drawings. It is to be noted, however, that the accompanying drawings are intended to be merely illustrative of the invention and not restrictive to the scope of the invention.

BRIEF DESCRIPTION OF THE DRAWINGS

The drawings illustrate an embodiment of this invention, wherein.

DETAILED DESCRIPTION OF THE INVENTION

The invention is now described in detail with reference to the drawings which illustrate a preferred embodiment of the invention.

Figure 1:
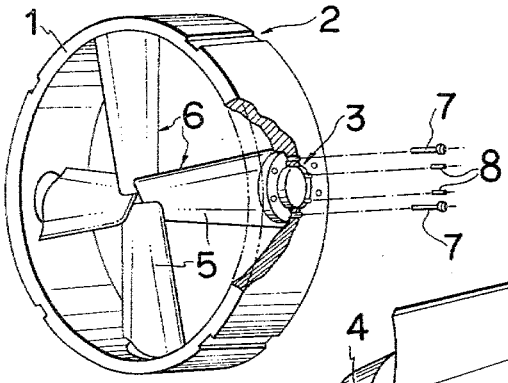
FIG. 1 is a perspective view, with a part broken away and shown in section, of a screw propeller made in accordance with the invention.

Referring first to FIG. 1, there is shown a perspective view of a screw propeller in accordance with the invention, with a part of the propeller unit being shown in section for the convenience of explanation.

In the figure, reference numeral 1 designates a cylinder which has formed in its outer peripheral surface a suitable number of equidistantly spaced-apart keyways 2. The cylinder 1 is formed with stepped holes 3 which are large in diameter at the inward portion and smaller in diameter at the outward portion, and in each of said stepped holes 3 is fitted a propeller member 6 consisting of a columnar proximal end portion 4 and a flat plate-shaped blade portion 5 extending along the center axis of said proximal end portion 4. The propeller member 6 is fitted into a corresponding stepped hole 3 in the cylinder 1 from the inside thereof such that the blade portion 5 extends toward the center axis of the cylinder while the proximal end portion 4 is directed outwardly, and the proximal end is secured to the cylinder 1 by means of bolts 7 in such a condition that the blade portion 5 is inclined a certain predetermined angle from the vertical plane to the center axis of the cylinder 1. The distal end of the blade portion 5 reaches a position close to the center axis of the cylinder 1. In order to ensure maintenance of the angle that is made by the blade portion 5 with the vertical plane to the center axis of the cylinder 1, the bolting fixation may be reinforced by driving hook pins 8 into the slots formed along the edge of each stepped hole 3.

The screw propeller according to the invention is constructed as described above, and it is mounted in the hull and connected to a driving power source such as a motor.

Now, a ship thruster device utilizing the bossless screw propeller is described with reference to the drawings.

Figure 5:
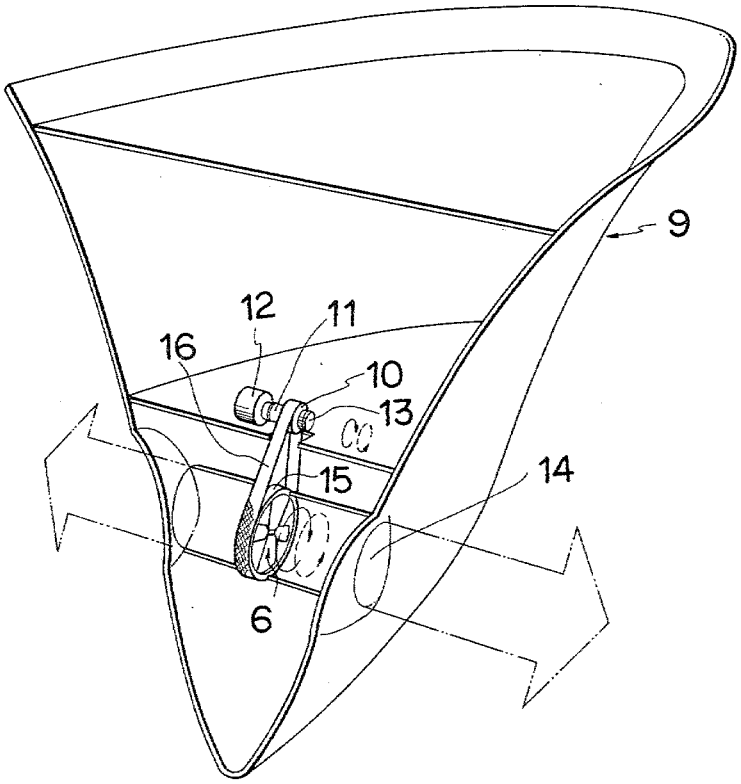
FIG. 5 is a perspective view showing adaptation of a thruster unit according to the invention at a location near the bow of a ship.
Figure 3:
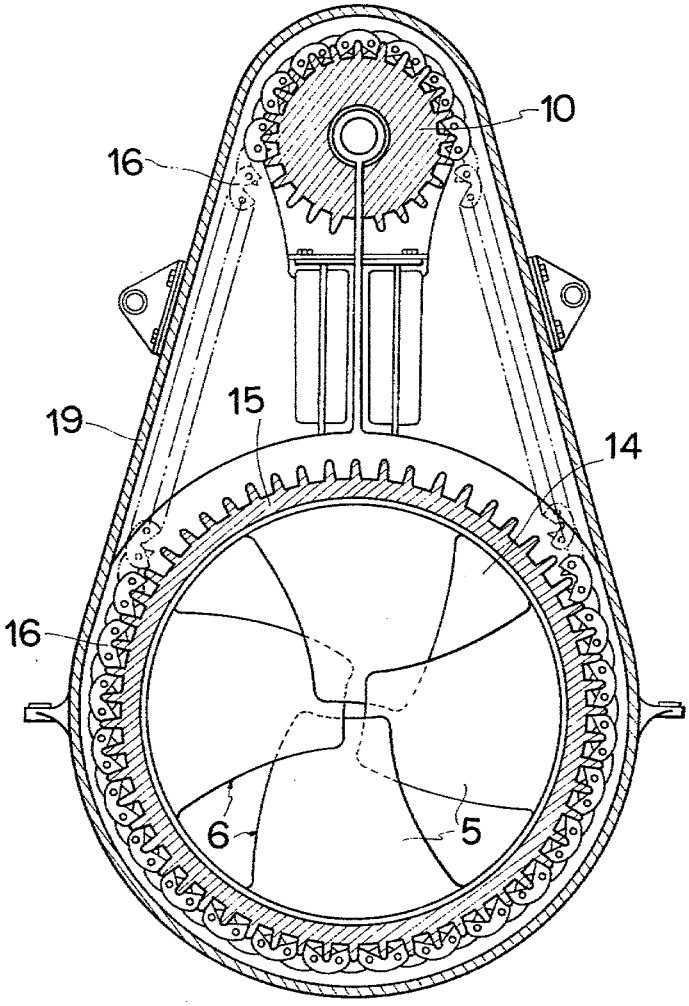
FIG. 3 is a front, cross-sectional view of a ship thruster unit.
Figure 4:
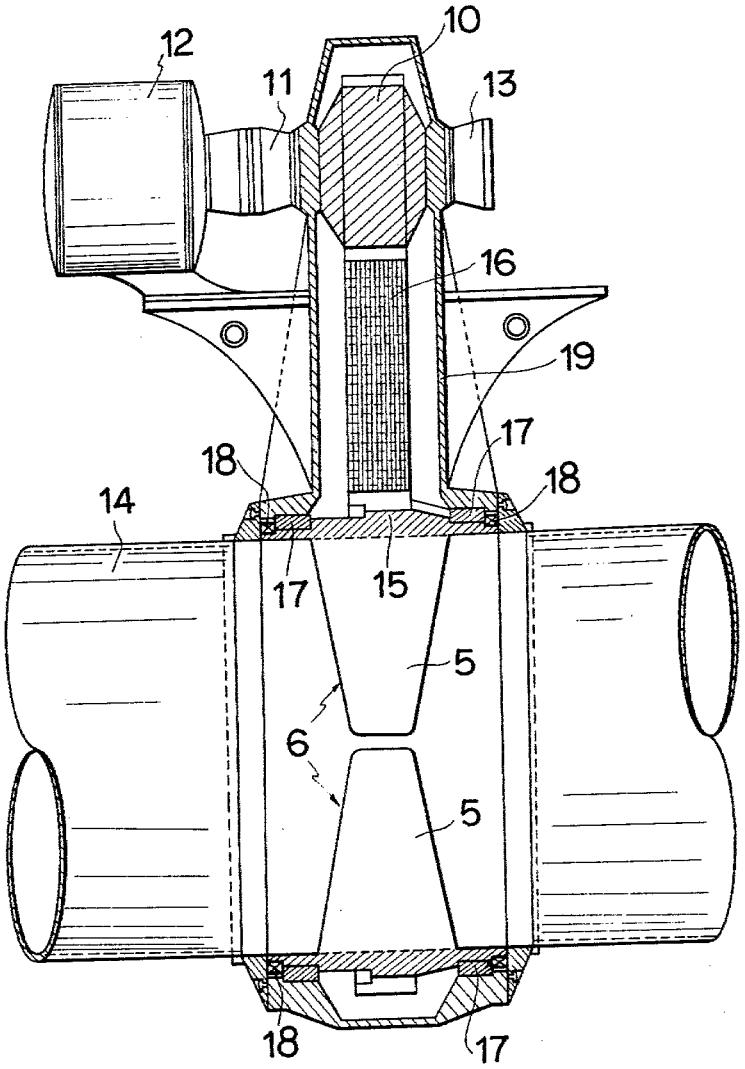
FIG. 4 is a side elevational view, partly in sections, of the ship thruster unit.

FIG. 3 is a front view of a thruster device according to the invention, and FIG. 4 is a side view thereof. Both drawings are shown partly in section for the convenience of explanation. FIG. 5 is a perspective view illustrating a mode of adaptation of a thruster unit at a location near the bow.

It will be seen that a motor 12 is mounted on the left side of a pinion 10 in the hull 9 through a coupling 11. The motor 12 is designed such that the direction of its rotation can be changed as desired, and the motor 12 may be disposed on the right side of the pinion 10 through a coupling 13, or two motors may be provided on both sides of the pinion 10. Other suitable alterations may be made within the overall scope and embodying the basic principle of the invention.

Figure 2:
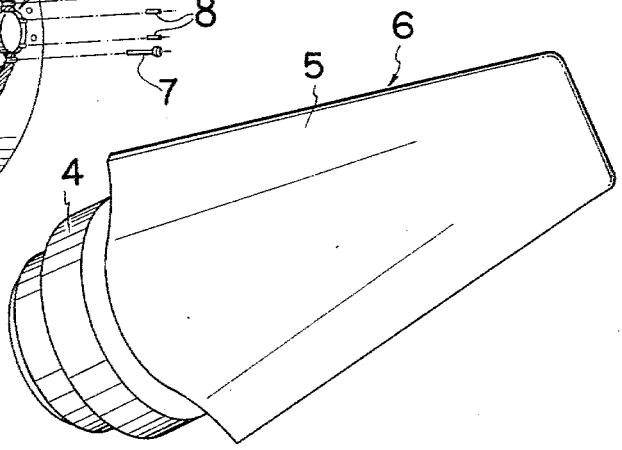
FIG. 2 is a perspective view of a propeller blade.

At a location near the front bottom of the hull 9 is provided a suction and exhaust hole 14 which extends horizontally to provide communication between the starboard and port sides of the hull. It will be noted that the cylinder 1 is rotatably fitted substantially at the middle of the suction and exhaust hole 14, and the cylinder 1 is provided inside thereof with four propeller blades 5 each of which extends to a point close to the center of the cylinder 1. Each of said propeller blades 5 is secured at its proximal end portion 4 to the inner periphery of the cylinder 1 as explained above with reference to FIG. 1 and FIG. 2. The propeller according to this invention has no shaft boss such as provided in conventional propellers. The propeller blades may be removably secured to the cylinder 1 by press-fitting or by screw engagement. This arrangement will facilitate manufacture and assembly of the propeller as well as replacement of any damaged or worn blades.

Provided around the cylinder 1 is a gear 15 which is connected to the pinion 10 by a silent chain 16. In the drawings, reference numeral 17 indicates a large-bored taper roller bearing and 18 an oil seal.

Figure 6:
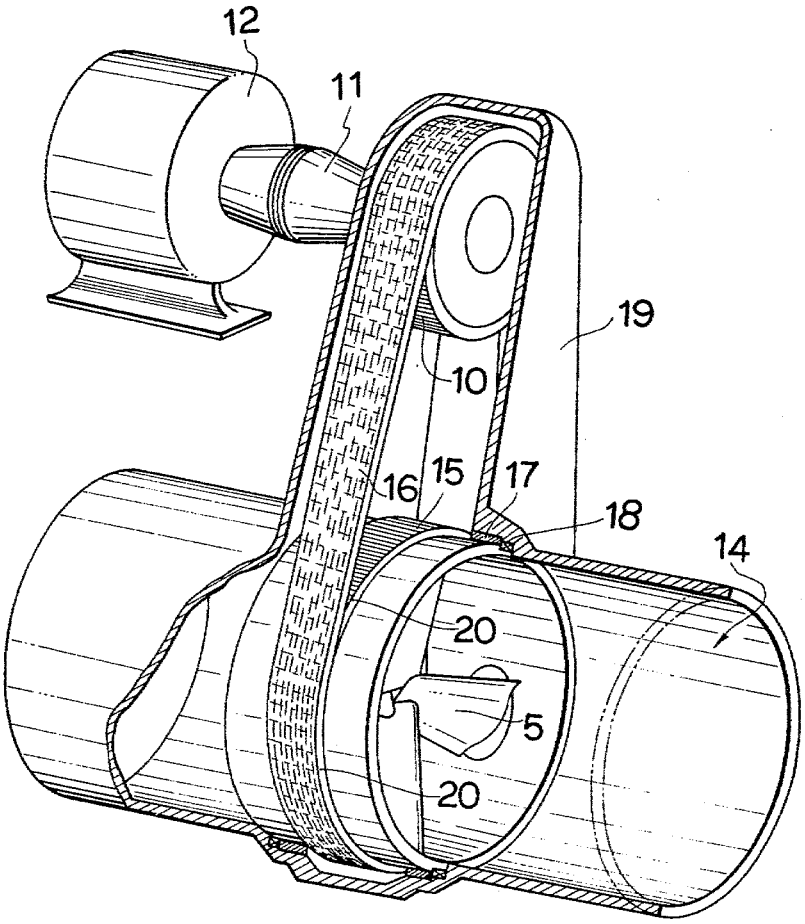
FIG. 6 is a perspective view of the ship thruster unit.

FIG. 6 shows in perspective a thruster arrangement similar to that shown in FIGS. 3 and 4 but having a casing 19 of a different configuration. The thruster construction is shown partly in section here, too, for the convenience of explanation. Numeral 20 in the drawing indicates keys.

The thruster device according to this invention is constructed as described above, and it is mounted in each of the suction and exhaust holes provided in the bow and stern and/or other locations and operated on a remote control system.

Referring here to FIG. 5, when the motor 12 is rotated in the direction of solid-line arrow, its rotation is transmitted to the pinion 10 by the motor coupling 11, while the rotation of the pinion 10 is conveyed to the gear 15 by the silent chain 16, causing rotation of the cylinder 1. As the propeller blades extending inwardly of the cylinder 1 are also accordingly turned in the direction of solid-line arrow, water is ejected to the right side of the suction and exhaust hole 14 to effect a leftward movement of the bow. On the other hand, when the motor 12 is rotated in the direction of broken-line arrow, a rightward movement of the bow is effected in the similar way. It will be understood that similar rightward or leftward movement of the stern can be effected by the thruster unit(s) provided at the stern and/or other suitable locations.

Thus, the ship mounted with the thruster device according to this invention is capable of making proper movement for coming alongside a pier or leaving therefrom by continuously ejecting water to the starboard or port side to shake the bow to the right or to the left.

The bossless screw propeller according to this invention and the ship thruster device using such propeller are capable of producing high hydraulic (bar water pressure) jet thrust like that of fire hose as the propeller blades are provided inside the cylinder 1. Such hydraulic thrust is far stronger than that provided by conventional propellers having a shaft boss. Therefore, the device of this invention allows easy and quick or high-efficient ship movement such as for coming alongside the pier or leaving the pier and also realizes highly enhanced steering performance, resulting in a sizable reduction of towing cost. Also, since there are further incorporated the double-row large-bored taper roller bearings and oil seals for ensuring oil- and water-tightness of the joints, the device can well withstand long-time operation. The torque loaded to the motor or to the shaft is also minimized.

While the present invention has been described by way of an embodiment as illustrated in the accompanying drawings, this invention is of course not limited to such particular embodiment.

As will be appreciated from the foregoing description, the bossless screw propeller according to this invention and the ship thruster device adapted with such propeller have many beneficial features and are of very high practical utility.

What I claim:

1. A ship thruster device comprising a rotatable cylinder disposed in a suction and exhaust hole in the hull of a ship, a plurality of propeller blades are removably secured to said cylinder and are inclined a predetermined angle from the vertical plane to the center axis of said cylinder, and said blades extending radially from the inner periphery of said cylinder to a point close to the center thereof, said cylinder including a gear about its periphery connected to a motor through a power transmitting means; and said cylinder having a plurality of stepped holes, larger in diameter at its inner portion and smaller in diameter at its outer portion, for securely seating and retaining in place the proximal end portions of said propellers and for facilitating assembly and replacement of the propellers.

2. A ship thruster as set forth in claim 1, wherein each propeller blade is secured to the cylinder by means of bolts and hook pins driven into the slots formed along the edge of each stepped hole.

3. A ship thruster device as set forth in claim 1, wherein the rotation of the motor is transmitted to a pinion through a coupling, and the rotation of said pinion is transmitted, by way of a silent chain, to said gear provided around said cylinder.

4. A ship thruster device as set forth in claim 1 or claim 3 , wherein said cylinder mounted is rotatably mounted in position in the hull by means of double-row taper roller bearings and cooperatively associated oil seals.

* * * * *